US009398817B2

(12) United States Patent
Daw

(10) Patent No.: US 9,398,817 B2
(45) Date of Patent: Jul. 26, 2016

(54) APPARATUS FOR FACING PRODUCTS

(75) Inventor: Conway Daw, Royston (GB)

(73) Assignee: BIG SKIES LIMITED, Hertfordshire (GB)

( * ) Notice: Subject to any disclaimer, the term of this patent is extended or adjusted under 35 U.S.C. 154(b) by 186 days.

(21) Appl. No.: 13/977,176

(22) PCT Filed: Dec. 19, 2011

(86) PCT No.: PCT/GB2011/052511

§ 371 (c)(1),
(2), (4) Date: Jun. 28, 2013

(87) PCT Pub. No.: WO2012/090003

PCT Pub. Date: Jul. 5, 2012

(65) Prior Publication Data

US 2013/0270205 A1 Oct. 17, 2013

(30) Foreign Application Priority Data

Dec. 29, 2010 (GB) ..... 1022038.2

(51) Int. Cl.

| | |
|---|---|
| ***A47F 1/00*** | (2006.01) |
| ***A47F 1/12*** | (2006.01) |
| ***A47F 7/28*** | (2006.01) |

(52) U.S. Cl.

CPC . *A47F 1/00* (2013.01); *A47F 1/125* (2013.01); *A47F 7/28* (2013.01)

(58) Field of Classification Search

CPC ..... A47F 1/04; A47F 1/12; A47F 1/123; A47F 1/125; A47F 1/126; A47F 5/005; A47F 7/28; A47F 1/00; G09F 3/204; G09F 11/30

USPC ..... 211/74, 59.2, 59.3

See application file for complete search history.

(56) References Cited

U.S. PATENT DOCUMENTS

| | | | |
|---|---|---|---|
| 2,079,754 | A | 5/1937 | Waxgiser |
| 3,357,597 | A | 12/1967 | Groff |

(Continued)

FOREIGN PATENT DOCUMENTS

| | | |
|---|---|---|
| CA | 1046014 | 1/1979 |
| CA | 1046014 A | 1/1979 |

(Continued)

OTHER PUBLICATIONS

International Search Report mailed May 25, 2012 for priority application PCT/GB2011/052511.

(Continued)

*Primary Examiner* — Patrick Hawn

(74) *Attorney, Agent, or Firm* — Troutman Sanders LLP; Ryan A. Schneider; Dustin B. Weeks

(57) ABSTRACT

The present invention relates to a facing arrangement which enables objects such as stock in a supermarket to be displayed effectively and clearly and positioned when required when stock is removed by customers. In one aspect there is a kit for aligning and drawing one or more objects across a support surface. The kit comprises a container for drawing the objects across the support surface, the container defining a zone for aligning objects, the zone defined between an opposing pair of side walls and an opposing pair of end walls. There is also an end element arranged to be secured adjacent an edge of the support surface and a spacer element configured to maintain a product spaced apart from the end element, the spacer element configured to provide a zone to accommodate an end wall of the container.

22 Claims, 20 Drawing Sheets

(56) References Cited

U.S. PATENT DOCUMENTS

Figure 1A:
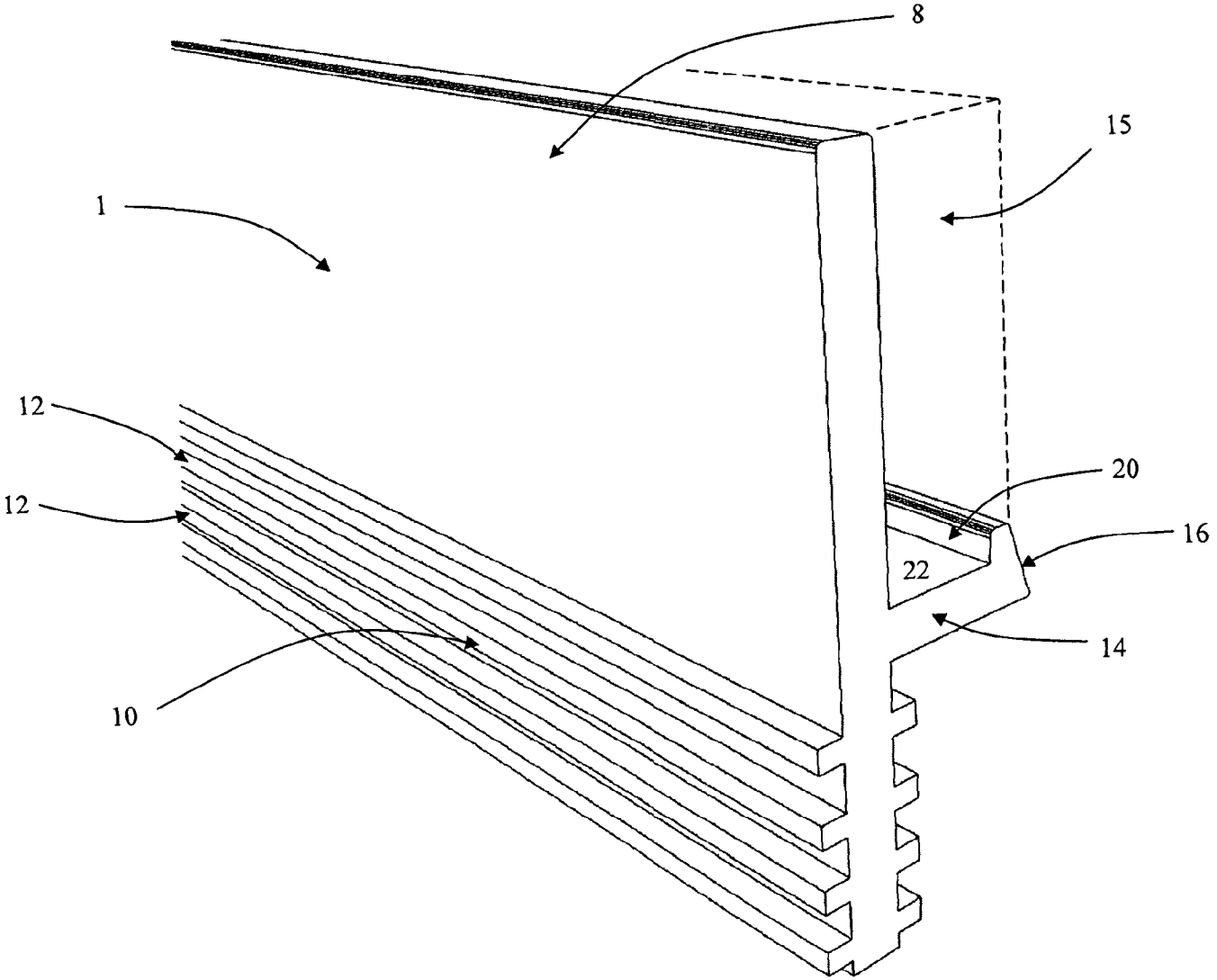

| | | | | |
|---|---|---|---|---|
| 4,685,574 | A | 8/1987 | Young et al. | |
| 5,111,942 | A * | 5/1992 | Bernardin | 211/59.3 |
| 5,232,102 | A * | 8/1993 | Ozawa | 211/49.1 |
| 5,361,895 | A * | 11/1994 | Wilson et al. | 229/101 |
| 5,555,990 | A | 9/1996 | Bechstein | |
| 5,904,256 | A * | 5/1999 | Jay | 211/59.2 |
| 6,047,647 | A * | 4/2000 | Laraia, Jr. | 108/61 |
| 6,357,606 | B1 * | 3/2002 | Henry | 211/59.3 |
| 6,375,015 | B1 | 4/2002 | Wingate | |
| 6,571,498 | B1 | 6/2003 | Cyrluk | |
| 6,739,461 | B1 | 5/2004 | Robinson | |
| 6,796,445 | B2 * | 9/2004 | Cyrluk | 211/183 |
| 7,086,541 | B2 * | 8/2006 | Robertson | 211/59.3 |
| 7,124,897 | B2 * | 10/2006 | Bustos | 211/59.3 |
| 7,168,579 | B2 * | 1/2007 | Richter et al. | 211/59.3 |
| D565,322 | S | 4/2008 | Mason | |
| 7,458,473 | B1 | 12/2008 | Mason | |
| 7,992,726 | B2 * | 8/2011 | Goehring | 211/59.2 |
| 8,066,128 | B2 * | 11/2011 | Crawbuck et al. | 211/59.3 |
| 2002/0023991 | A1 | 2/2002 | Harris et al. | |
| 2002/0170197 | A1 | 11/2002 | Close | |
| 2003/0020294 | A1 | 1/2003 | Berry | |
| 2003/0024889 | A1 | 2/2003 | Dumontet | |
| 2003/0196979 | A1 * | 10/2003 | Cyrluk | 211/183 |
| 2005/0258113 | A1 | 11/2005 | Close et al. | |
| 2009/0084745 | A1 * | 4/2009 | Goehring | 211/134 |
| 2012/0204458 | A1 * | 8/2012 | Goehring | 40/642.02 |

FOREIGN PATENT DOCUMENTS

| | | | |
|---|---|---|---|
| CA | 1046014 | A1 | 1/1979 |
| EP | 0614638 | | 9/1994 |
| JP | 2000-325191 | | 11/2000 |
| JP | 2000-350643 | | 12/2000 |
| NL | 9200560 | A | 3/1992 |
| WO | 2001077597 | | 10/2001 |
| WO | 2009029099 | A1 | 3/2009 |

OTHER PUBLICATIONS

Search Report issued by the Intellectual Property Office dated Apr. 26, 2011 for related British Patent Application No. GB1022038.2.

International Search Report and Written Opinion dated May 25, 2012, issued by the European Patent Office for related PCT Patent Application No. PCT/GB2011/052511.

Search Report issued by the Intellectual Property Office dated Jun. 3, 2014 in GB Application No. GB1407512.1.

* cited by examiner

APPARATUS FOR FACING PRODUCTS

CROSS-REFERENCE TO RELATED APPLICATIONS

This application is a US National Stage of International Application No. PCT/GB2011/052511, filed 19 December 2011, which claims the benefit of GB 1022038.2, filed 29 December 2010, both herein fully incorporated by reference.

The present invention relates to a facing arrangement which enables objects such as stock in a supermarket to be displayed effectively and clearly, and positioned as required when stock is removed by customers.

The displaying of products on support structures such as shelves in a retail outlet is important as it can have a significant effect on the sale of the product and on the appearance of the retail outlet as a whole. Stock such as bottles are removed from a shelf leaving spaces and periodically supermarkets, for example, 'face up' which is to pull stock forward to the front of the shelves and this may happen at least twice a day, firstly towards the end of the filling time which is often overnight and secondly once in the afternoon. Facing up can be difficult with deep shelves, tall fixtures and valuable stock which is vulnerable to being knocked off the shelves. If the stock is not brought to the front of the shelves, it is likely that consumers will not see the product or will, at the belief that the presentation in the retail outlet is poor, lead to a question mark over the quality of the store. Wine bottles for example are displayed on shelves as individual bottles rather than as whole cases and are not well suited to retail ready packaging where several products are placed onto a shelf in one go in a cardboard tray because wine bottles are heavy and a high value purchase that does not look attractive when displayed in cardboard. Further problems for example with wine bottles tend to be that stock at the back of the shelves splays out and the stock gets mixed up as more stock is pushed on at the front of the shelves. This makes stock counting difficult. Stock counts regularly happen in retail outlets particularly with a high value product meaning that retail outlets often have to spend a lot of time straightening products on the shelves in order to do the stock count.

In order to overcome the above-mentioned problem, various types of equipment have been proposed to help in particular but not exclusively wine bottle merchandising. Systems such as pusher systems have been designed however there are disadvantages as they work well at keeping the bottles at the front of the shelves but take approximately three times as long to fill and can irritate customers who like to browse the wine and often need to put bottles back. In this scenario the gap for putting the bottles back has disappeared. Furthermore, such arrangements are expensive and have moving parts that are susceptible to failure.

An alternative arrangement is disclosed in CA1046014. In this disclosure, there is an arrangement comprising a number of channels for receiving products defined in a rectangular shaped receptacle. A handle which protrudes through a stop 6 including rail 12 can be pulled by a retail outlet employee which causes a roll 15 to contact a rear object in the series meaning that the objects are drawn forwards and contact the rail 12 meaning that the objects are at the front of a shelf. The roll 15 is self recoiling against a sprung element.

There are disadvantages associated with such an arrangement.

According to one aspect of the present invention there is a kit for aligning and drawing one or more objects across a support surface, the kit comprising:

a container for drawing the objects across the support surface, the container defining a zone for aligning objects, the zone defined between an opposing pair of side walls and opposing pair of end walls; and an end element arranged to be secured adjacent an edge of the support surface; and a spacer element configured to maintain a product spaced apart from the end element, the spacer element configured to provide a zone to accommodate an end wall of the container.

There are significant advantages associated with the present invention. The spacer element ensures that the products or objects to be drawn across the surface (typically bottles) are spaced from the end element which can be termed a riser, meaning that a zone or space is provided in which the end wall of the container can be accommodated. It will be appreciated that the end wall of the container may or may not be in actual physical communication with the spacer element or the end element depending on its exact configuration.

The spacer element is beneficially fixedly attached to the end element and is beneficially formed integrally therewith. This means that the end element or riser may be formed of a single continuous extrusion out of a polymeric material.

The end element beneficially has a longitudinal length and the spacer element beneficially includes a protruding member extending generally perpendicular to the longitudinal length of the end element. This protruding member has a contact edge at which the object or product on the support surface cannot extend beyond. The protruding member preferably provides a surface for accommodating the end wall of the container. The protrusion beneficially projects across the support when in use, as the end element is typically positioned at an edge of the support. The protrusion preferably defines a channel for receiving an end wall of the container. Accordingly, this channel is defined by a lip and the longitudinal length of the end element and thus once the end wall of the container or a portion of the end wall of the container is located therein, the container cannot be accidentally moved perpendicular to the longitudinal length of the end element.

The lip preferably extends substantially parallel to the longitudinal length of the end element. The lip is preferably continuous.

There is preferably further provided an arrangement for securing the end element to the support and the arrangement for securing the end to the support beneficially comprises one or more deformable ribs, which locate into a channel provided at an edge of a typical shelf that may be found in a supermarket. The outer wall that defines this channel generally has a further protrusion extending therefrom which receives indicia, which informs the customer of the product provided on the shelf.

The container preferably comprises first and second opposing side walls, wherein at least one of the first or second end wall includes an end wall portion secured to a side wall, the end wall portion being received by a retaining element secured to the opposing side wall, wherein the end wall portion is moveable relative to the retaining element to enable adjustment of the span between the opposing side walls of the container.

It is beneficial to enable adjustability of the width of the container to enable facing of objects, preferably bottles, having different diameters.

The container preferably comprises a receiving element at both opposing end walls. Accordingly, the span between opposing side walls of the container can be maintained in the complete longitudinal length of the container and therefore the width remains substantially constant. The side walls therefore remain parallel.

The receiving element preferably includes a channel for receiving the end wall portion and enabling moveable engagement therebetween. At least one side wall is beneficially fixed relative to the receiving element. Accordingly, one of the side walls is moveable relative to the opposing side wall plus receiving element. It will be appreciated however that both side walls may be moveable relative to the receiving element.

The side walls are preferably substantially parallel and comprise end wall portions extending perpendicular to the side walls, each of the end wall portions being received by the receiving element. One end wall portion is preferably fixed relative to the receiving element. The receiving element may include a retaining member arranged to prevent release of the moveable end wall portion from the receiving element. The retaining member is preferably provided in order that a maximum span between opposing side walls cannot be exceeded.

The side wall preferably comprises a notch adjacent the intersection between the side wall and the end wall. This notch is beneficial as it enables the end wall to extend into the zone provided by the spacer element.

The side wall preferably has a variable height. At least one of the side walls preferably tapers towards the intersection between the side wall and the end wall.

Each end of the container preferably includes a receiver element.

According to a further aspect of the present invention there is a container for drawing objects across a support surface defining a zone for aligning objects, the zone having a width defined between an opposing pair of side walls and a longitudinal length defined by an opposing pair of end walls, wherein at least one end wall has an end wall portion secured to a side wall and is received by a complementary retaining element secured to the opposing side wall, wherein the end wall portion is moveable relative to the retaining element to thereby enable adjustment of the container width.

Also according to an aspect of the present invention there is an end element arranged for securing adjacent an edge of a shelf, and a spacer element configured to maintain a product spaced apart from the end element, the spacer element configured to provide a zone to accommodate an end wall of a container.

It will be appreciated that indication or information for a customer may be provided on the opposing side of the end element to the zone to accommodate an end wall of the container.

The present invention will now be described by way of example only with reference to the accompanying drawings in which:

FIG. 1*a* is a schematic perspective rearward view of an end element or riser according to an exemplary embodiment of the present invention.

Figure 1B:
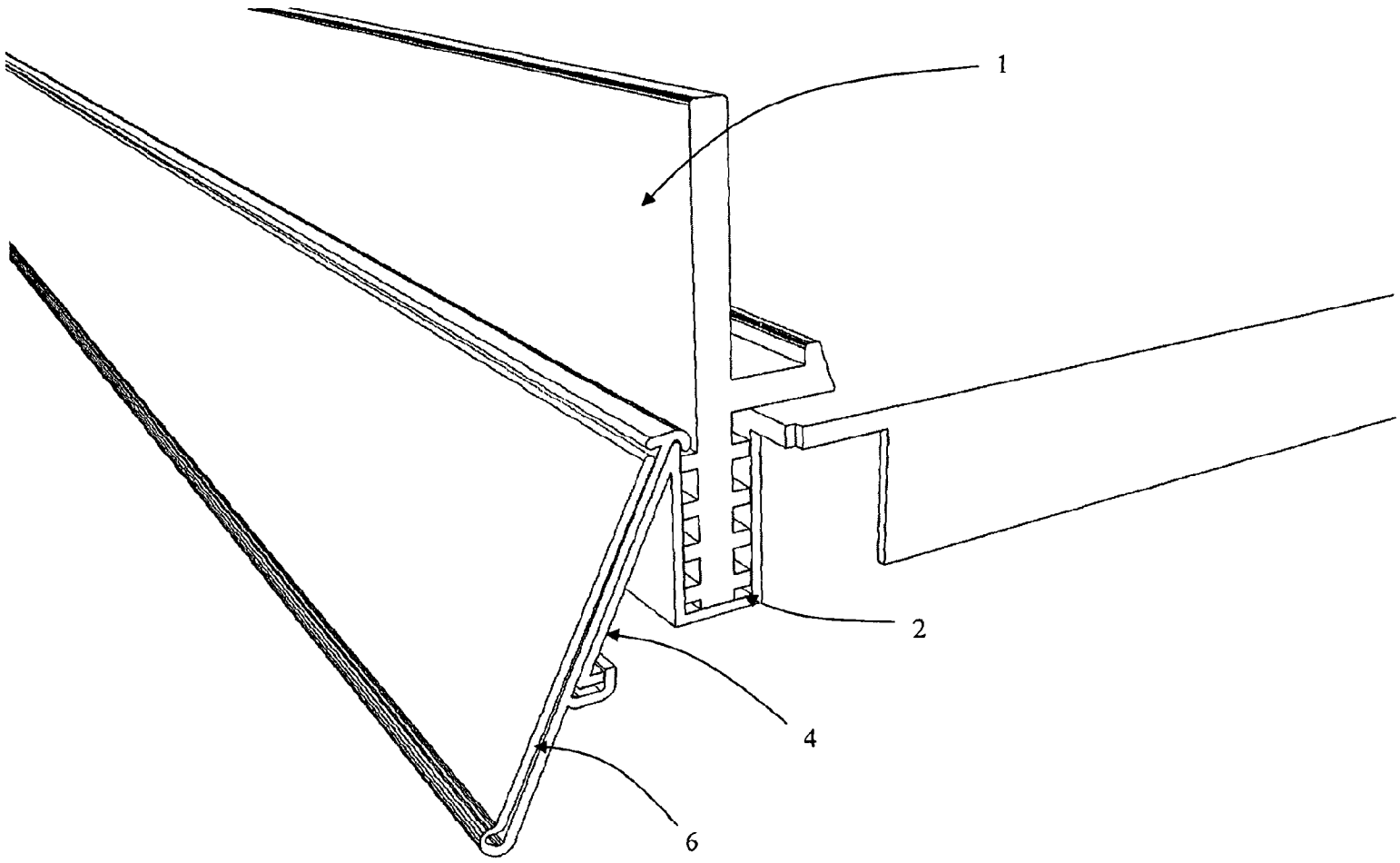

FIG. 1*b* is a schematic rearward view of an end element or riser according to an exemplary embodiment of the present invention located in a channel provided at an edge of a shelf.

FIGS. 2*a*-2*e* are schematic side views of an end element or riser and container according to an exemplary embodiment of the present invention in the stored configuration, and through the subsequent steps of "facing" products.

FIGS. 3*a*-3*e* are shown in the action of "facing" being performed on a line of objects on a shelf that is otherwise full.

Figure 4A:
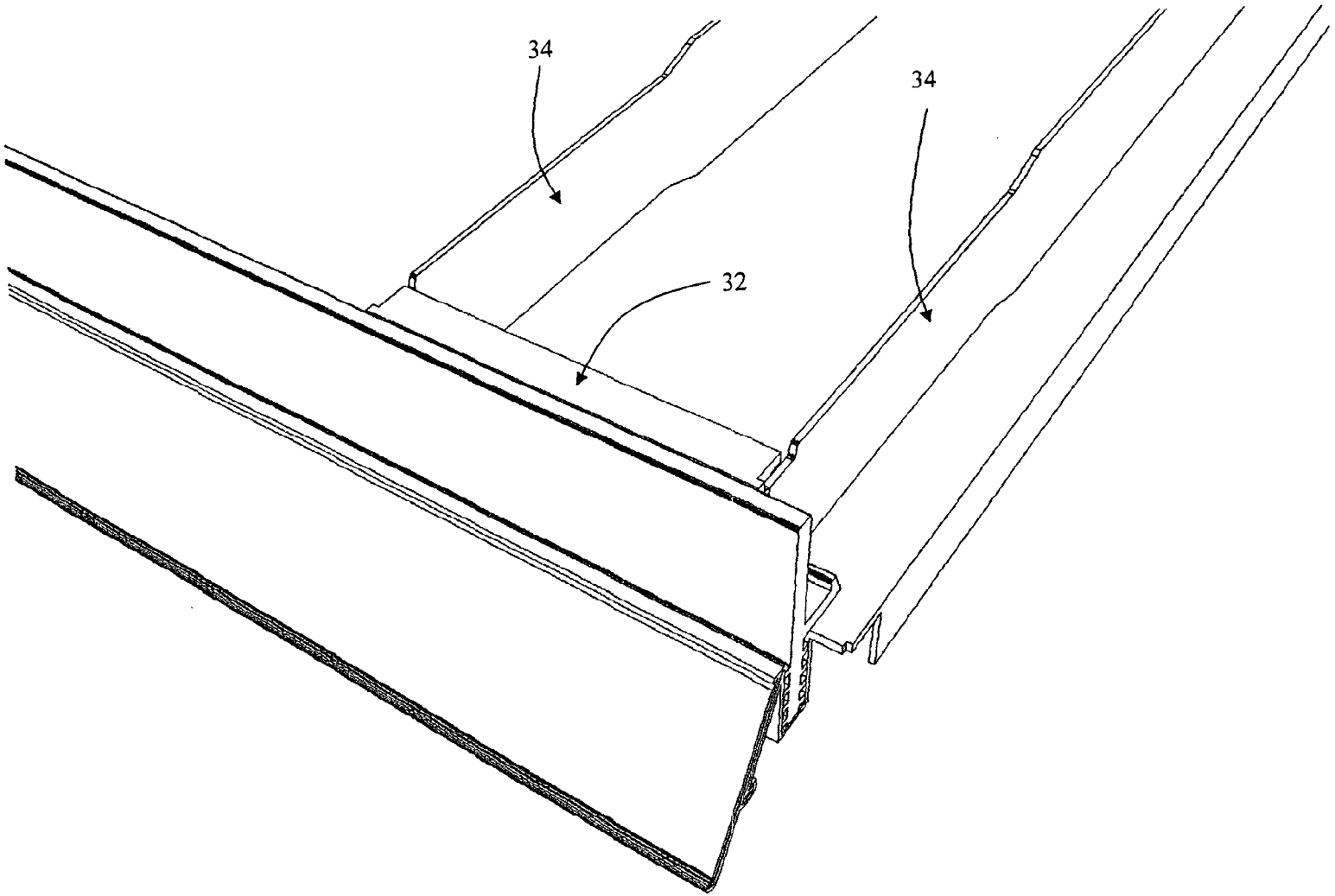
Figure 4B:
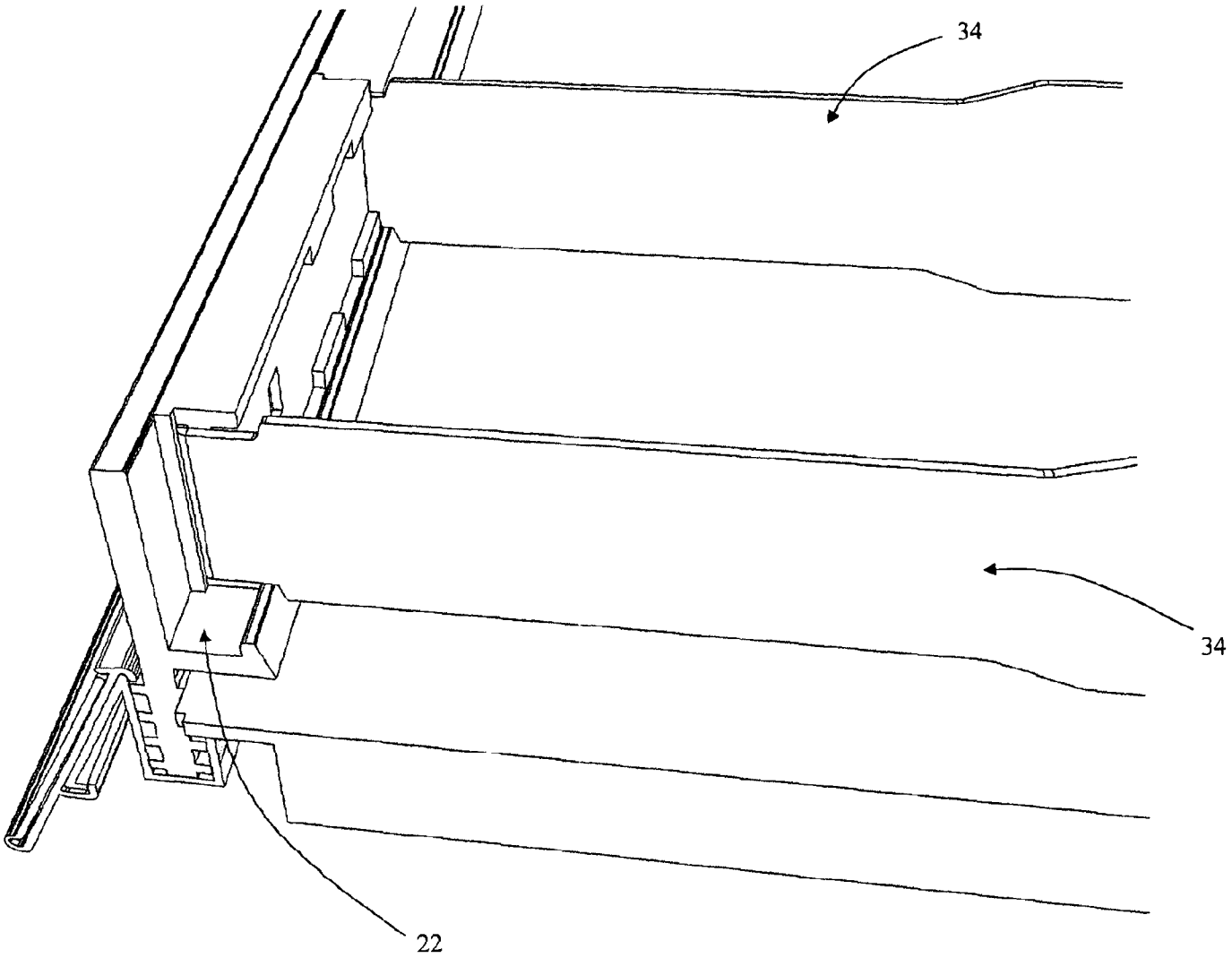
Figure 4C:
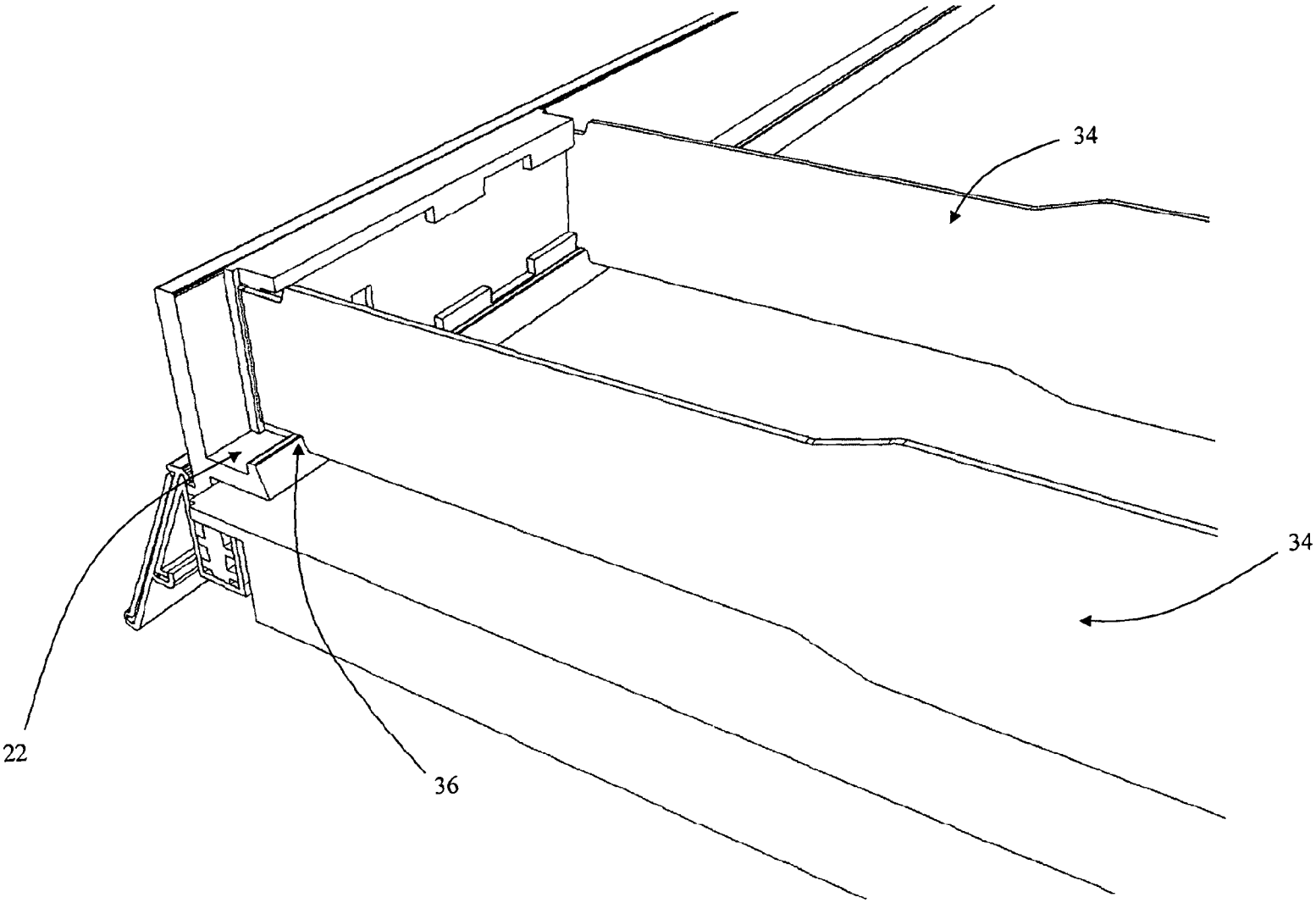

FIGS. 4*a*-*c* are schematic views of an end wall of the container positioned in the stored configuration relative to the end element or riser.

FIGS. 5*a*-*d* are schematic views of the adjustability of the end walls of the container as the width of the container decreases from wide through to narrow.

Figure 6:
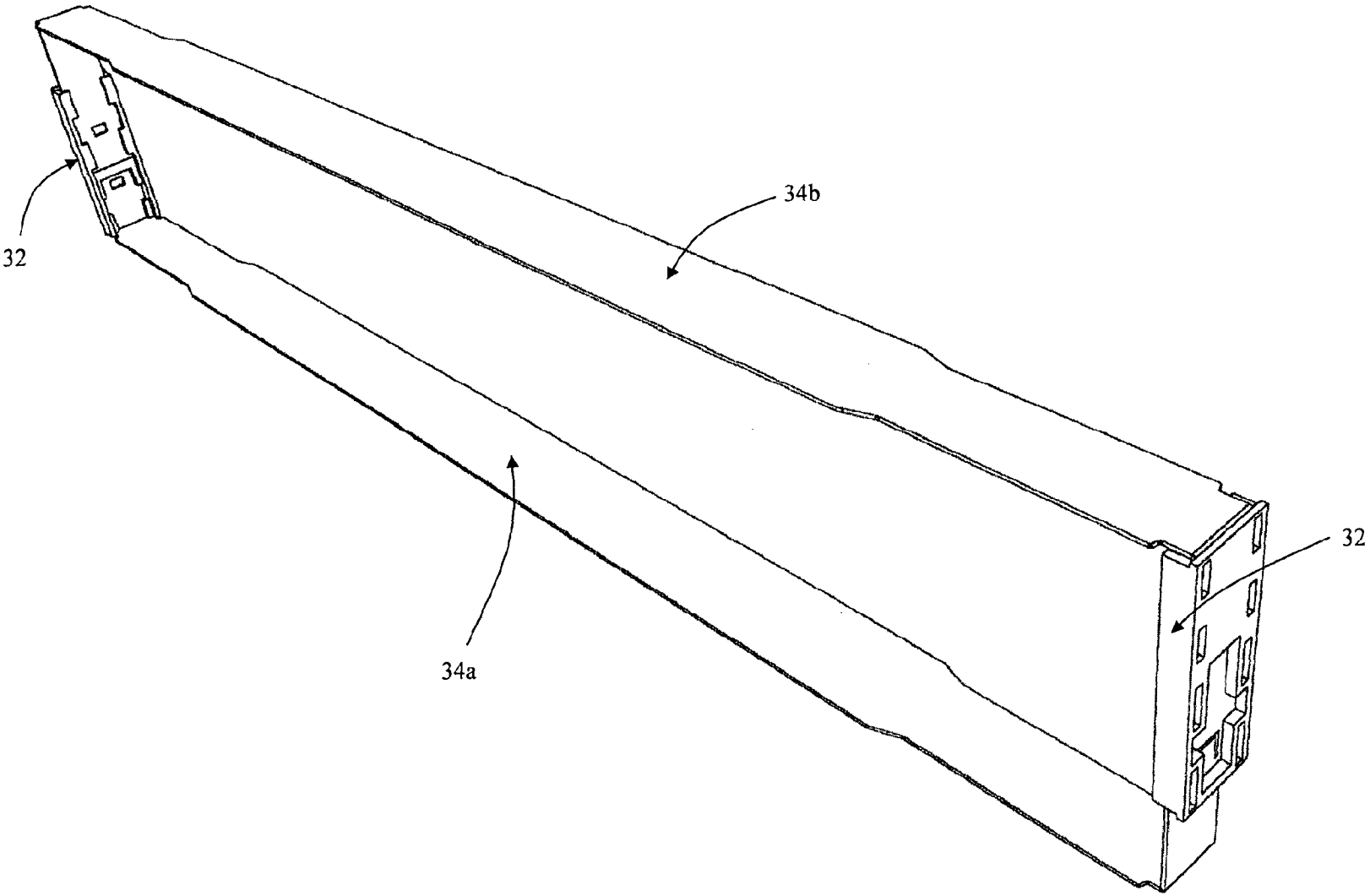

FIG. 6 is a schematic perspective view of a container according to an exemplary embodiment of the present invention.

Referring to FIG. 1*a* there is a schematic perspective rear side view of a riser 1 according to an aspect of the present invention and in FIG. 1*b* there is a schematic perspective view of a rear side view of the riser located with a channel found at an edge of a shelf on which products are displayed. The profile of the edge of the shelf shows a channel 2 and a surface 4 sloping from the upper end of an edge defining an edge of the channel 2 onto which a clear plastic element 6 is provided into which information to identify the product on the shelf is located.

The riser 1 comprises an upright portion 8 and a securing portion 10 for securing into the channel 2. In the embodiment shown, the riser 1 is manufactured of an extruded polymeric material, and the securing portion 10 comprises a plurality of ribs 12 which preferably extend in the longitudinal length of the riser 1 and are elastically deformable such that they achieve a snug friction fit in the channel 2. The riser 1 further comprises a protrusion 14 extending in the exemplary embodiment shown in a direction generally perpendicular to the longitudinal length of the riser 1. The first function of the protrusion 14 is to provide a spacing element between the upright portion of the riser 1 and the forward edge 16 of the protrusion 14. Accordingly, a zone 15 is therefore provided defined by the upright portion of the riser and the forward edge of the protrusion 14 that may accommodate a part of or edge of the container (described later). The zone 15 is represented by dashed lines in FIG. 1*a*. When in use as shown in FIG. 1*b*, it is clear that objects such as wine bottles stored on the shelf cannot extend beyond the forward edge 16 of the protrusion 14. This means that the bottles cannot fall from the shelf, and also means that the zone for receipt of an end edge of the container is provided. A lip 20 is also preferably provided extending upwardly and in the same longitudinal length as the riser 1 which acts to retain the end edge of the container to prevent unwanted movement of the container away from the riser 1. A channel 22 is therefore defined between the upright portion of the riser 1 and the lip 20.

Figure 2A:
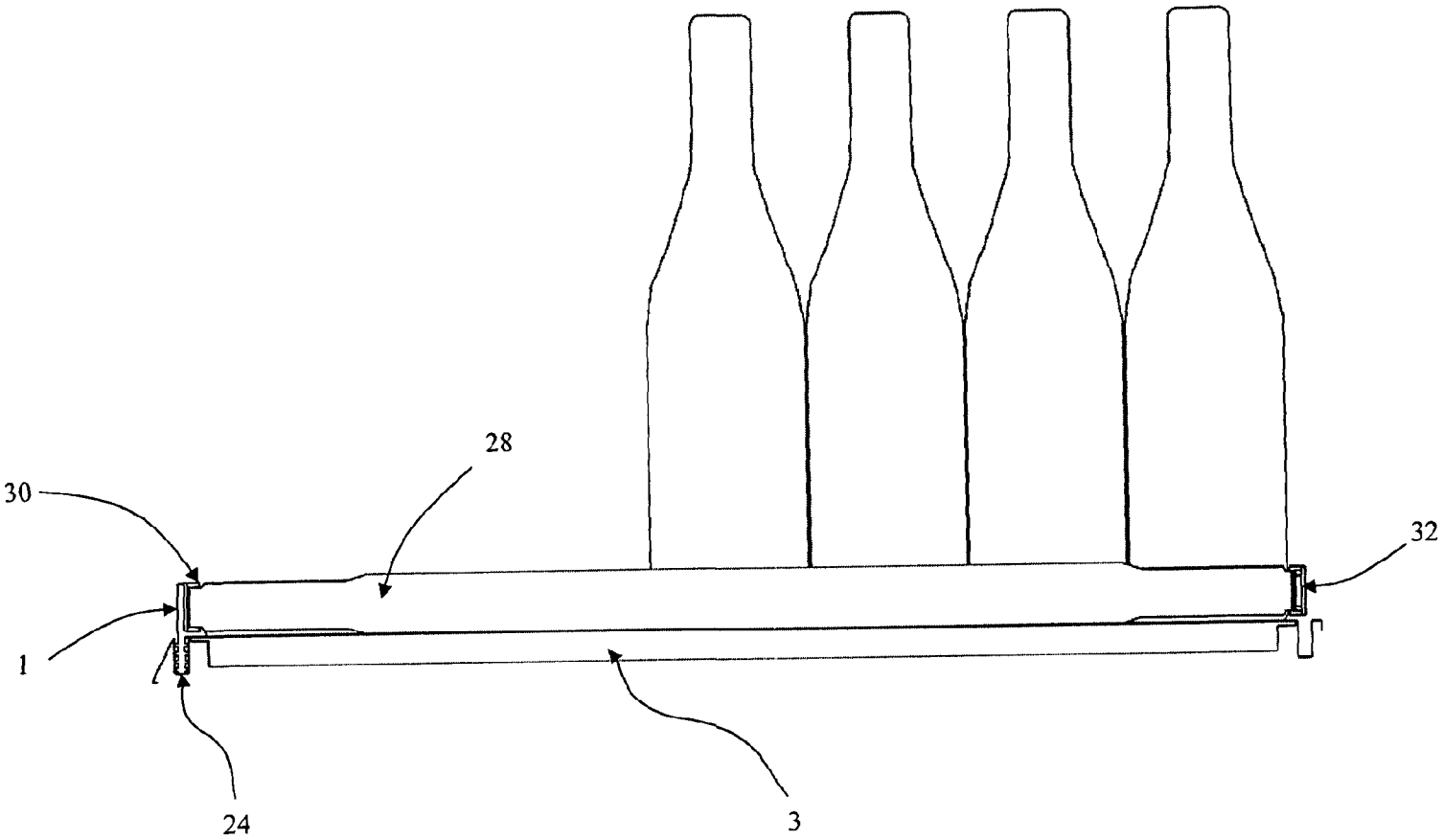
Figure 2B:
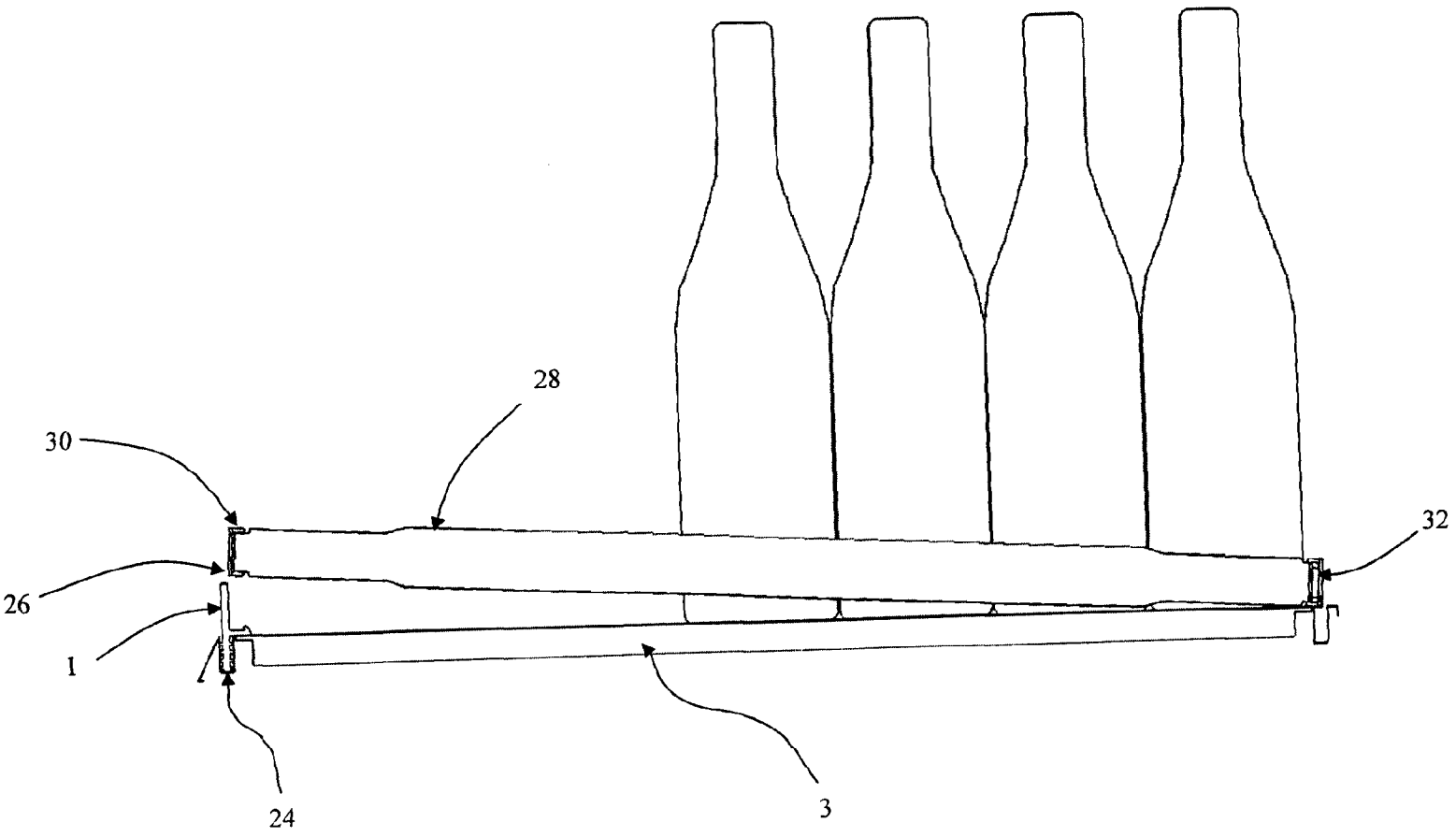
Figure 2C:
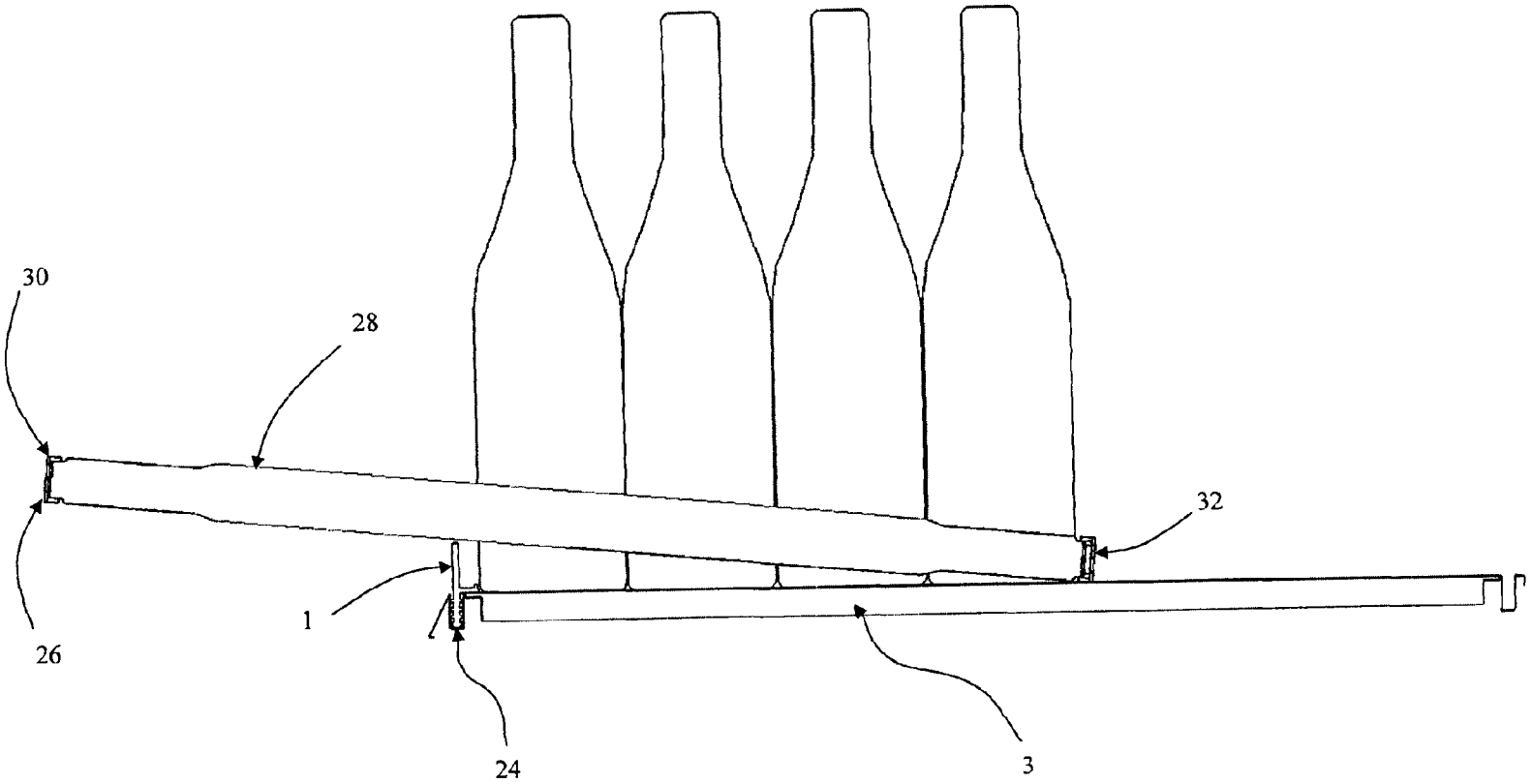
Figure 2D:
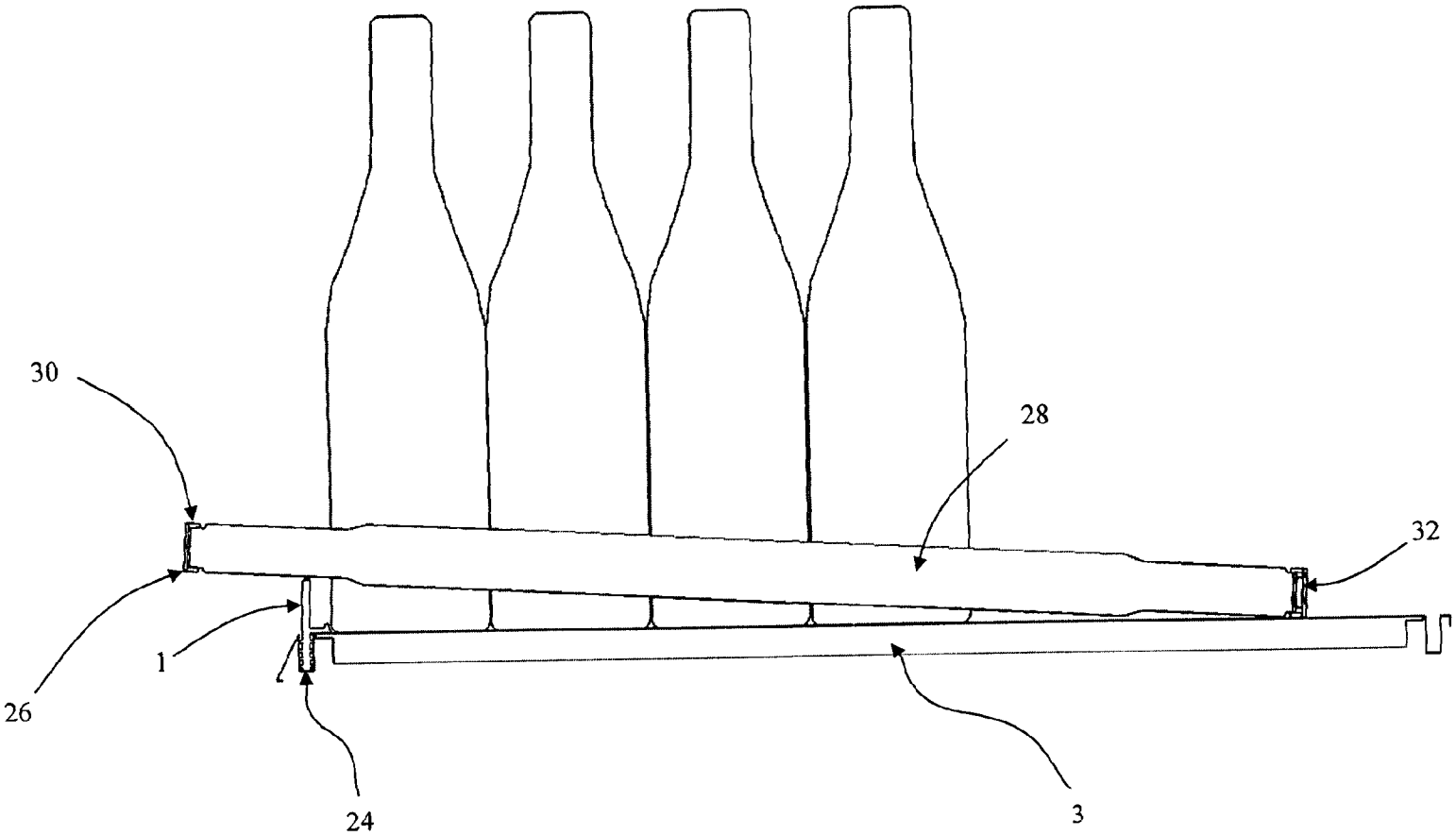
Figure 2E:
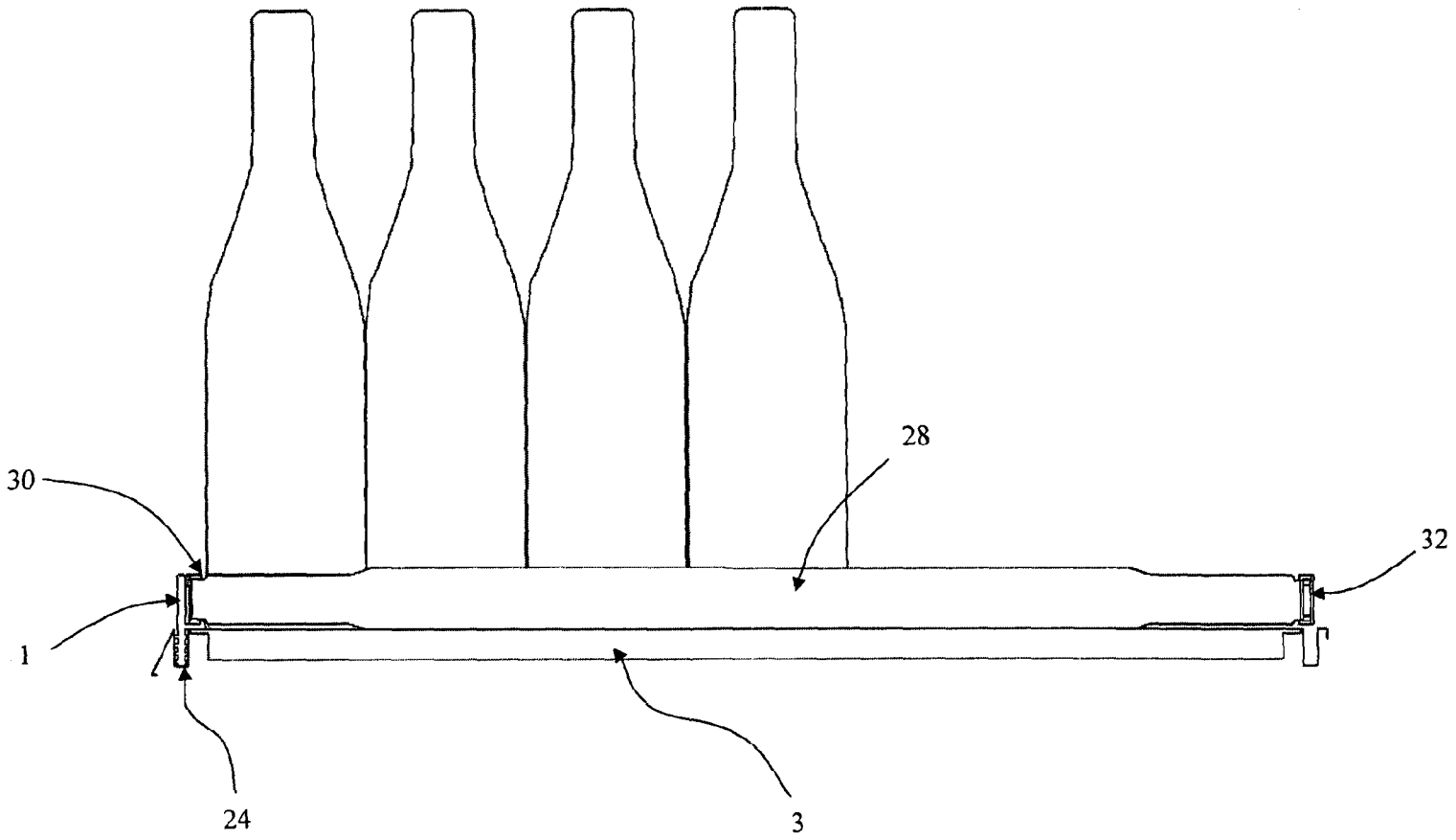
Figure 3A:
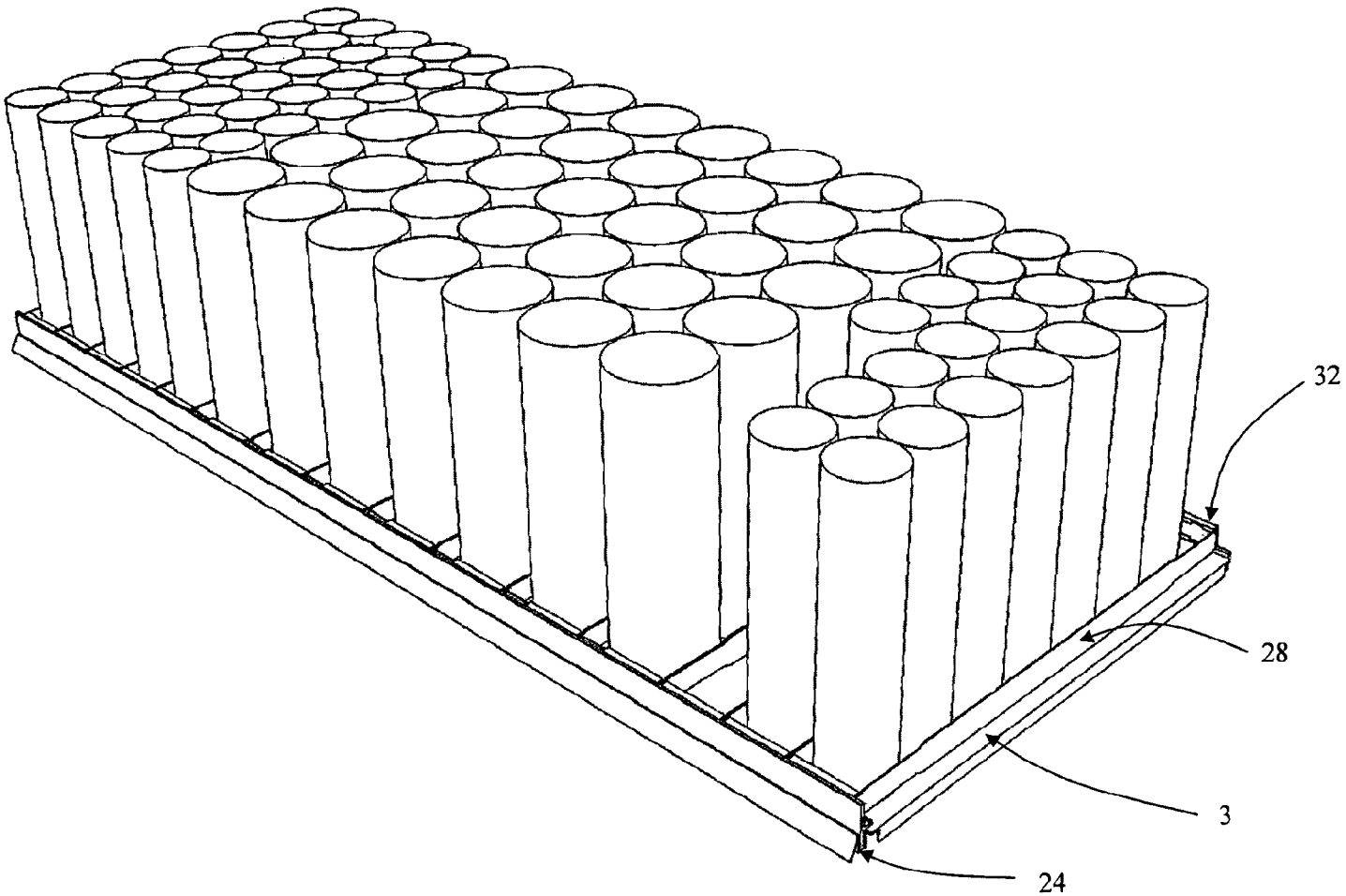
Figure 3B:
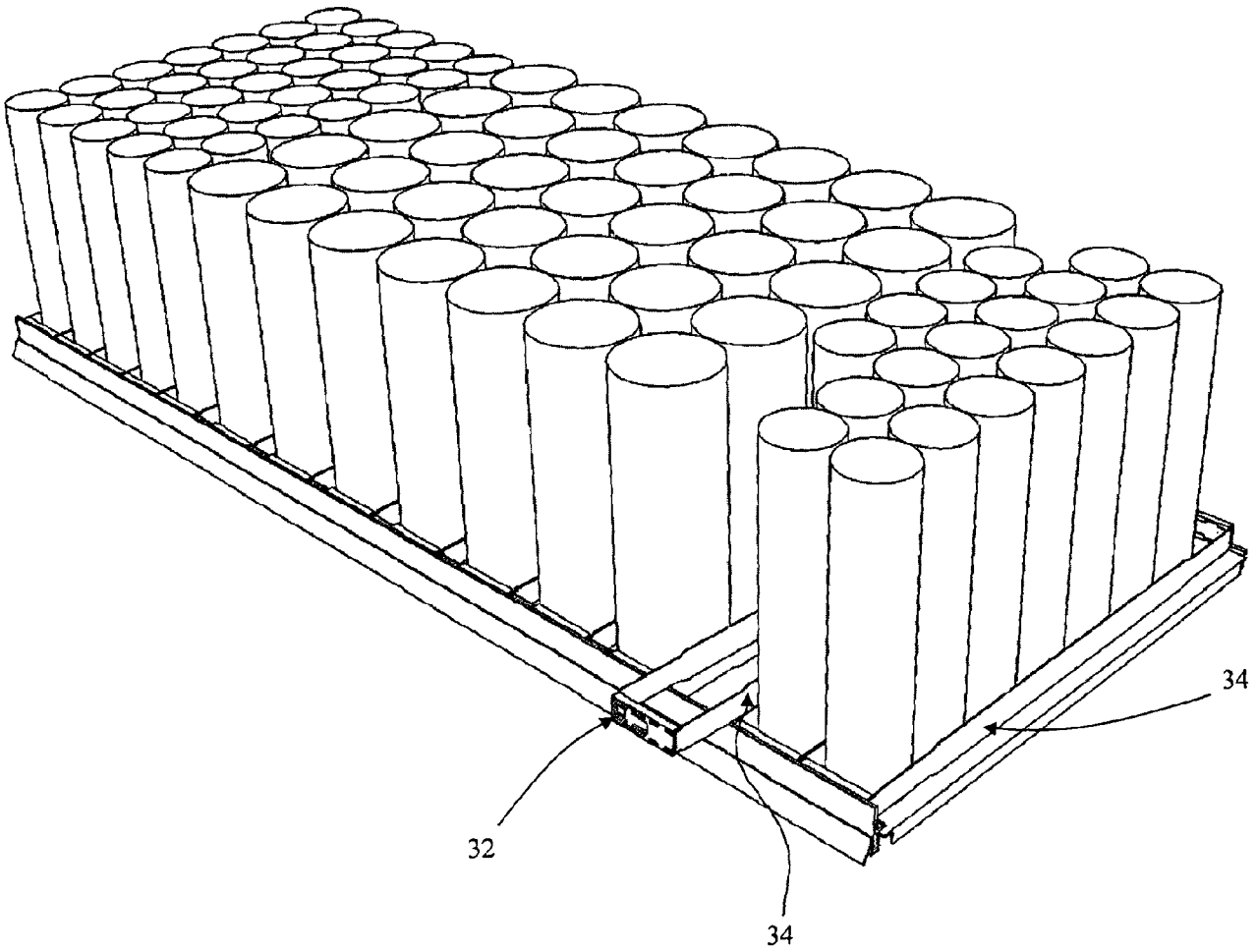
Figure 3C:
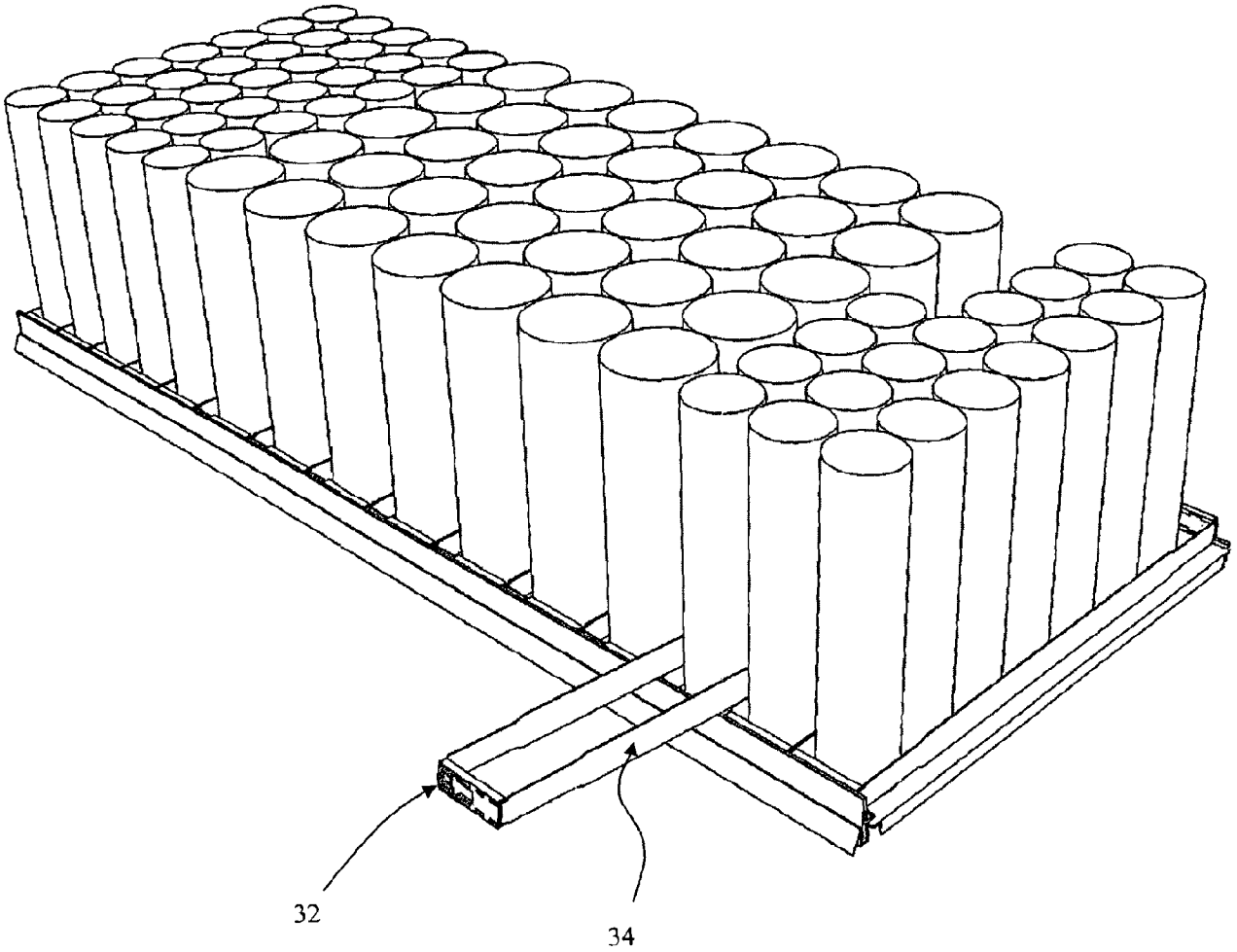
Figure 3D:
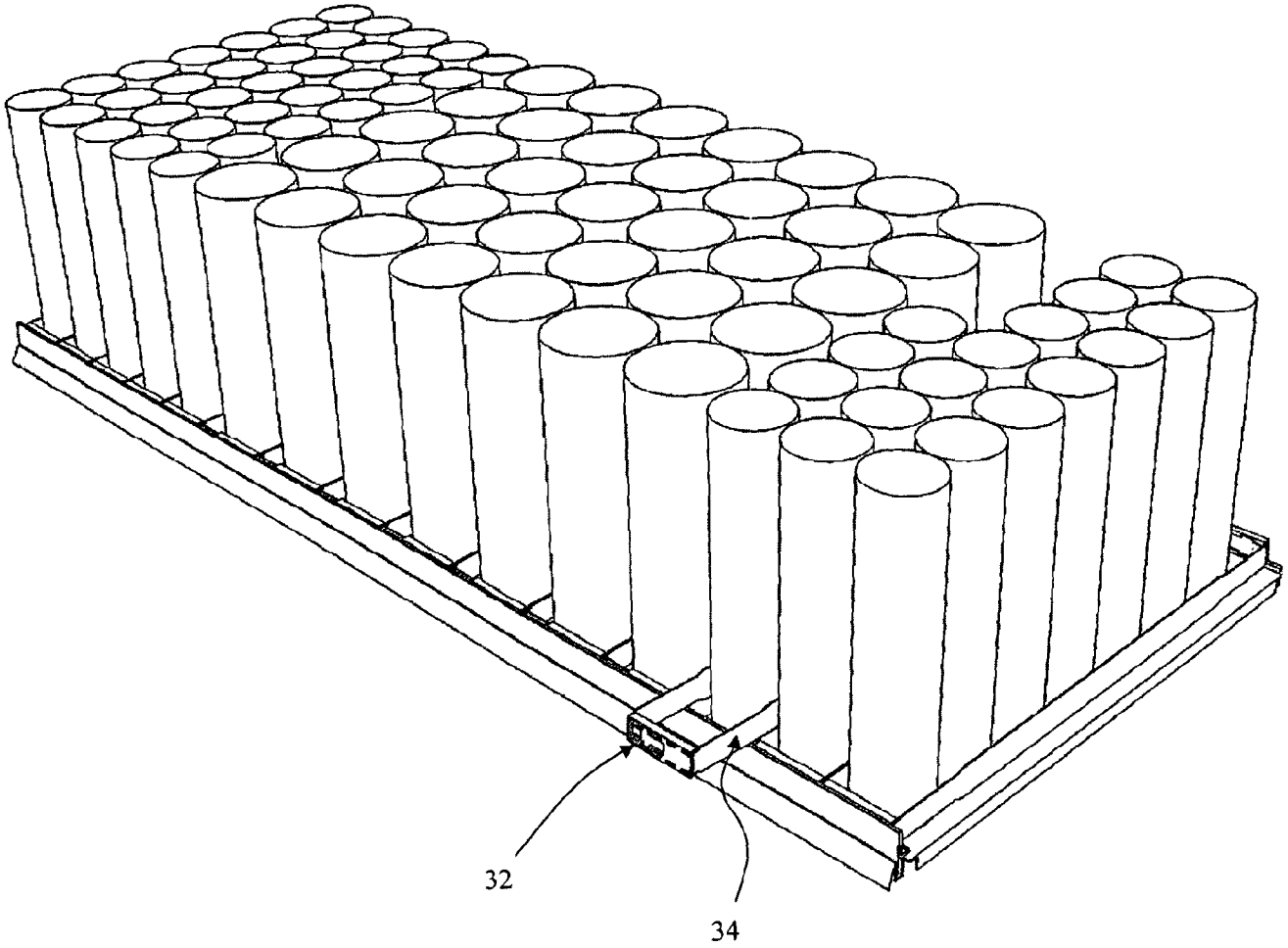
Figure 3E:
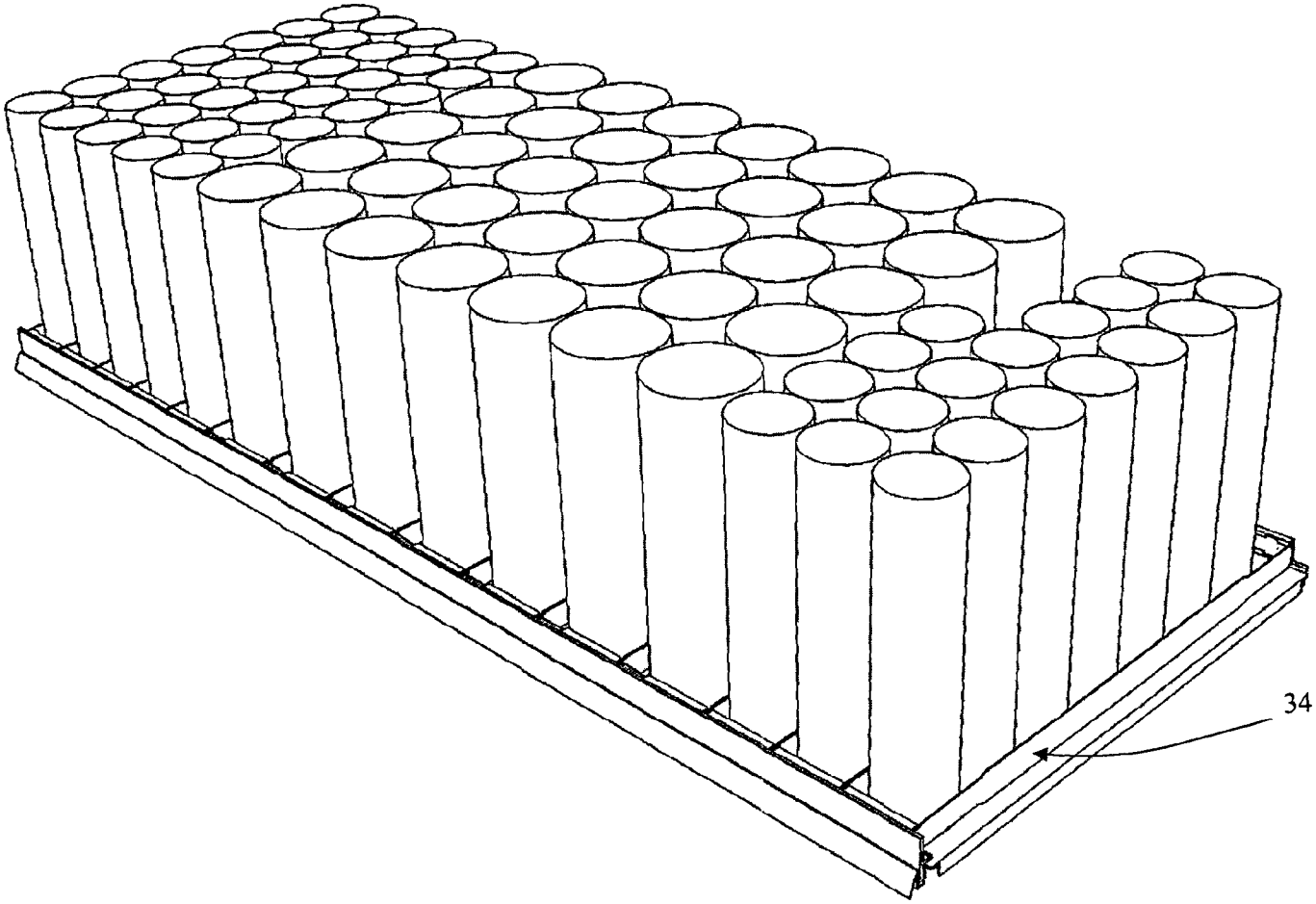

Referring to FIGS. 2*a*-2*e*, a shelf 3 is shown and a riser 1 is provided secured in a channel 24 which may be formed as part of the shelf 3. The edge 26 of the end wall of the container 28 can be seen to sit in the channel 22 provided between the lip 20 and upright portion of the riser 1. FIG. 2*a* shows the stowed configuration, which is the normal configuration of the container 28 relative to the shelf 3 and riser 1. When objects have been removed from the shelf 3, the shop operative grasps the forward end edge 30 of the container and moves the container to the position as shown in FIG. 2*b*. This is an intermediate position, in which the forward end of the container 28 is raised. The bottles are then drawn across the surface of the shelf due to the application of force at the rearward end edge 32, until the point is reached at which all of the bottles are aligned and the forward bottle abuts the forward edge 16 of the protrusion 14 (FIG. 2*c*). The container 28 is then pushed back (FIG. 2*d*) and then replaced into the stowed configuration (FIG. 2*e*).

FIGS. 3*a*-3*e* show the same steps as presented in FIGS. 2*a*-2*e* in perspective view with a plurality of objects and containers on a shelf.

Referring to FIGS. 4*a*-*c*, there are shown three views of the end wall of the container 28 positioned adjacent the riser in the stored configuration. The end wall of the container 28 preferably comprises a receiving element 32 which receives the side walls 34 of the container 28. In the stored configuration, the receiving element 32 of the riser 1 sits in the channel 22 and the top of the receiving element 32 sits substantially flush with the top of the upright portion of the riser. A notch 36 is cut out from adjacent the end of the end of the side walls 34 arranged to accommodate the lip 20. Accordingly in the stored configuration the container can only move in the longitudinal direction of the riser 1, however this movement direction will not be significant due to the bottles located with the container and the number of adjacent containers maintaining each other in relative position. It will be appreciated that in use the receiving element 32 is grasped and lifted for the bottles to be drawn to the front of the shelf, then can be retracted and re-located within the channel 22.

Figure 5A:
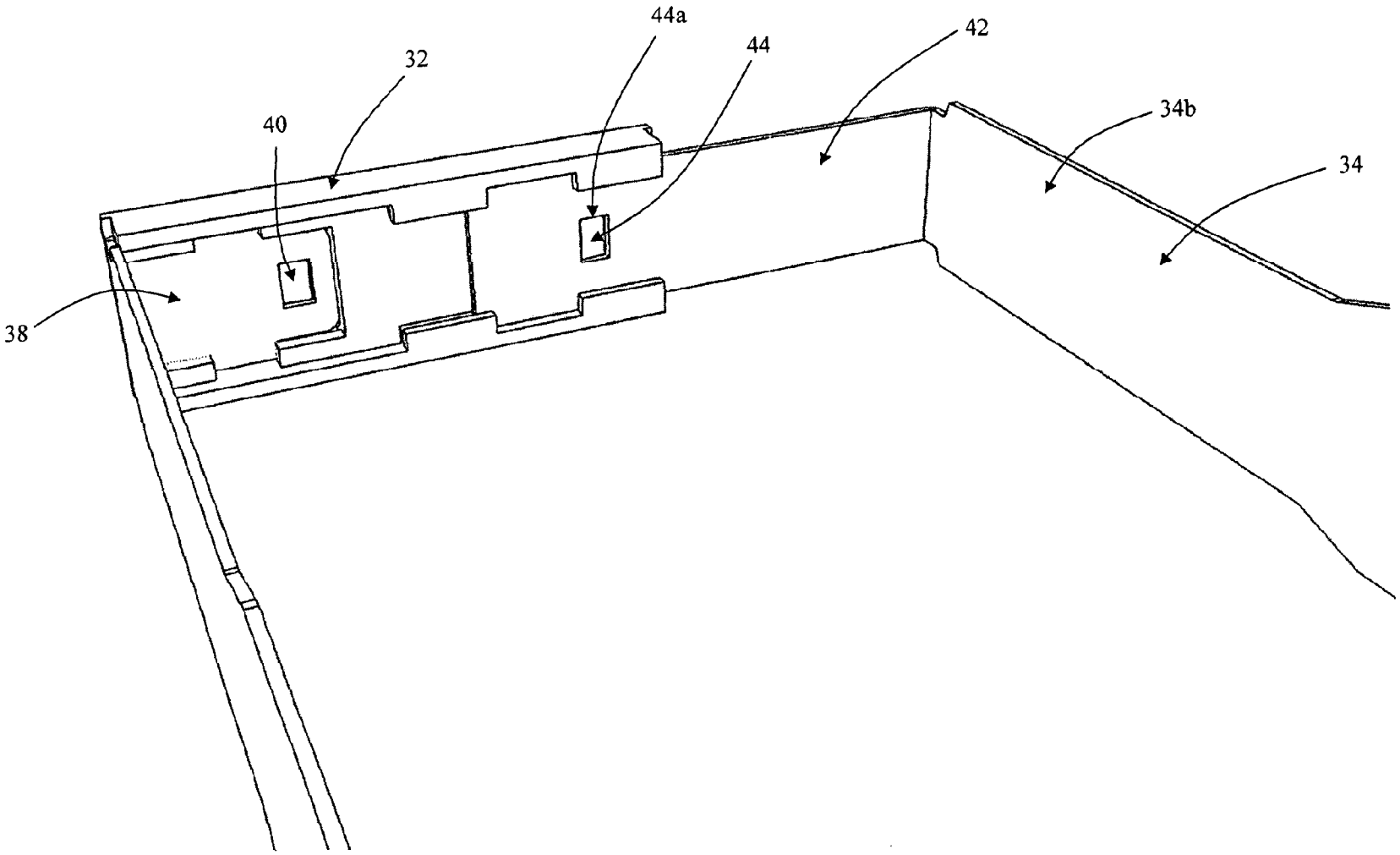
Figure 5B:
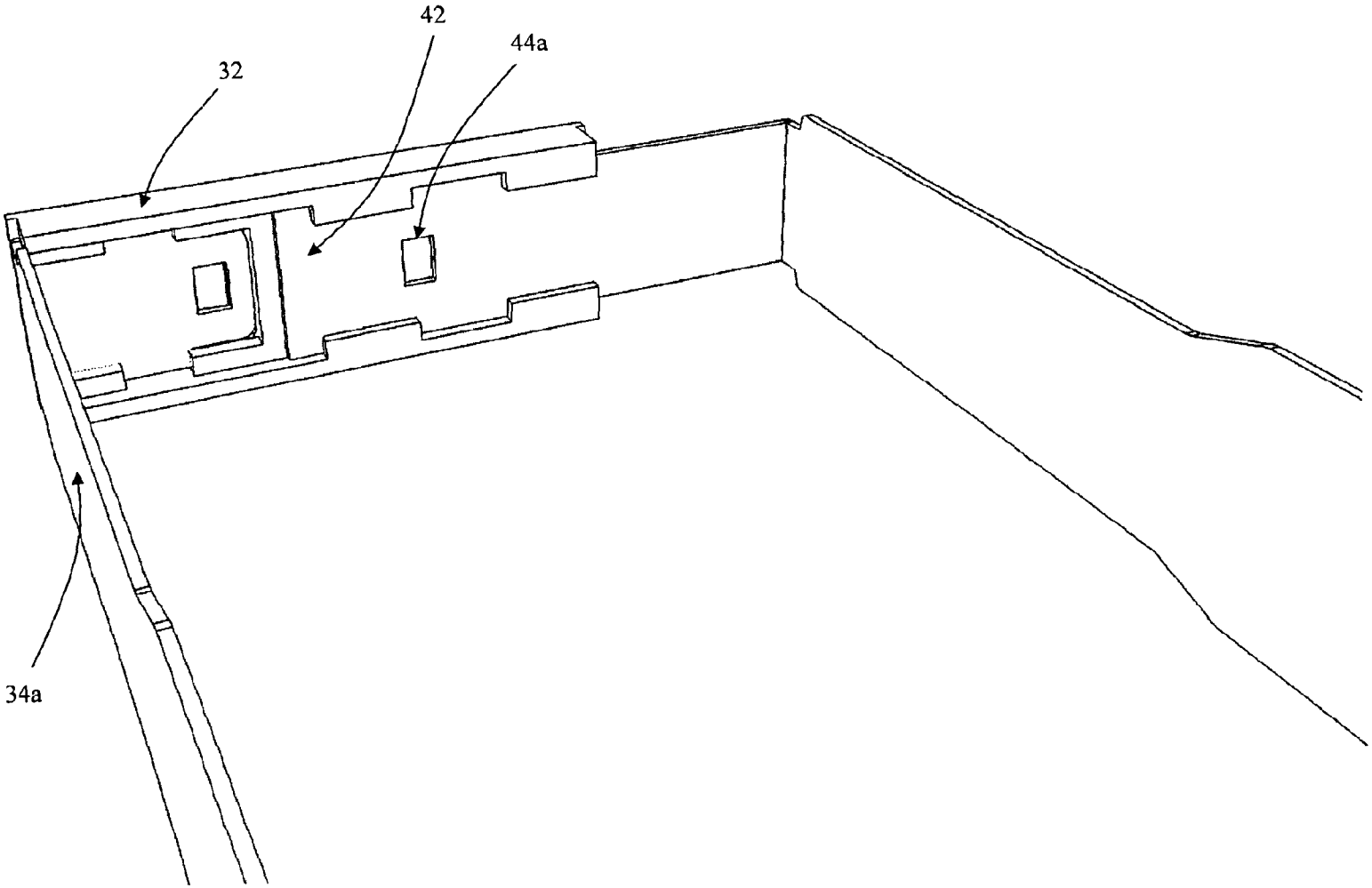
Figure 5C:
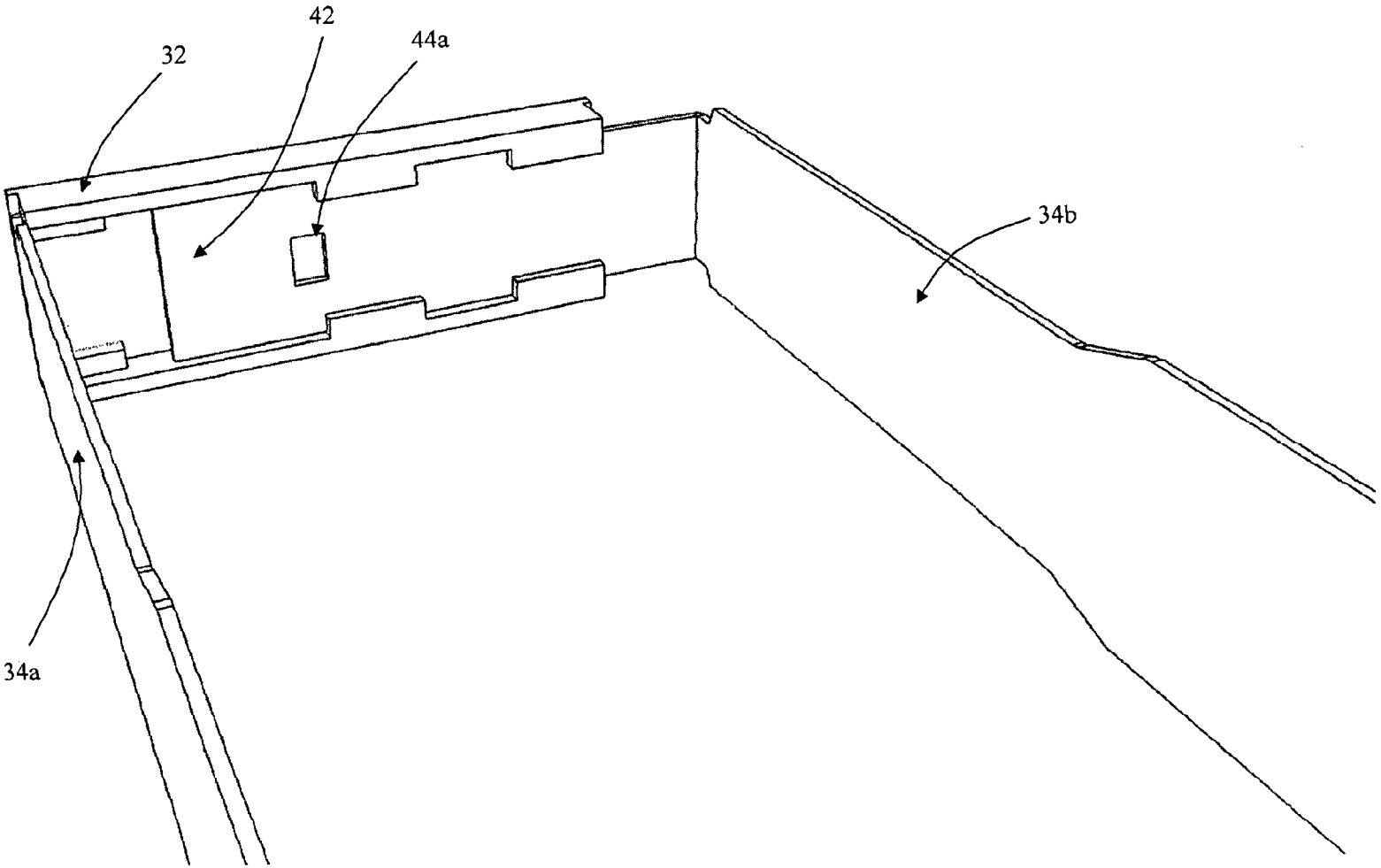
Figure 5D:
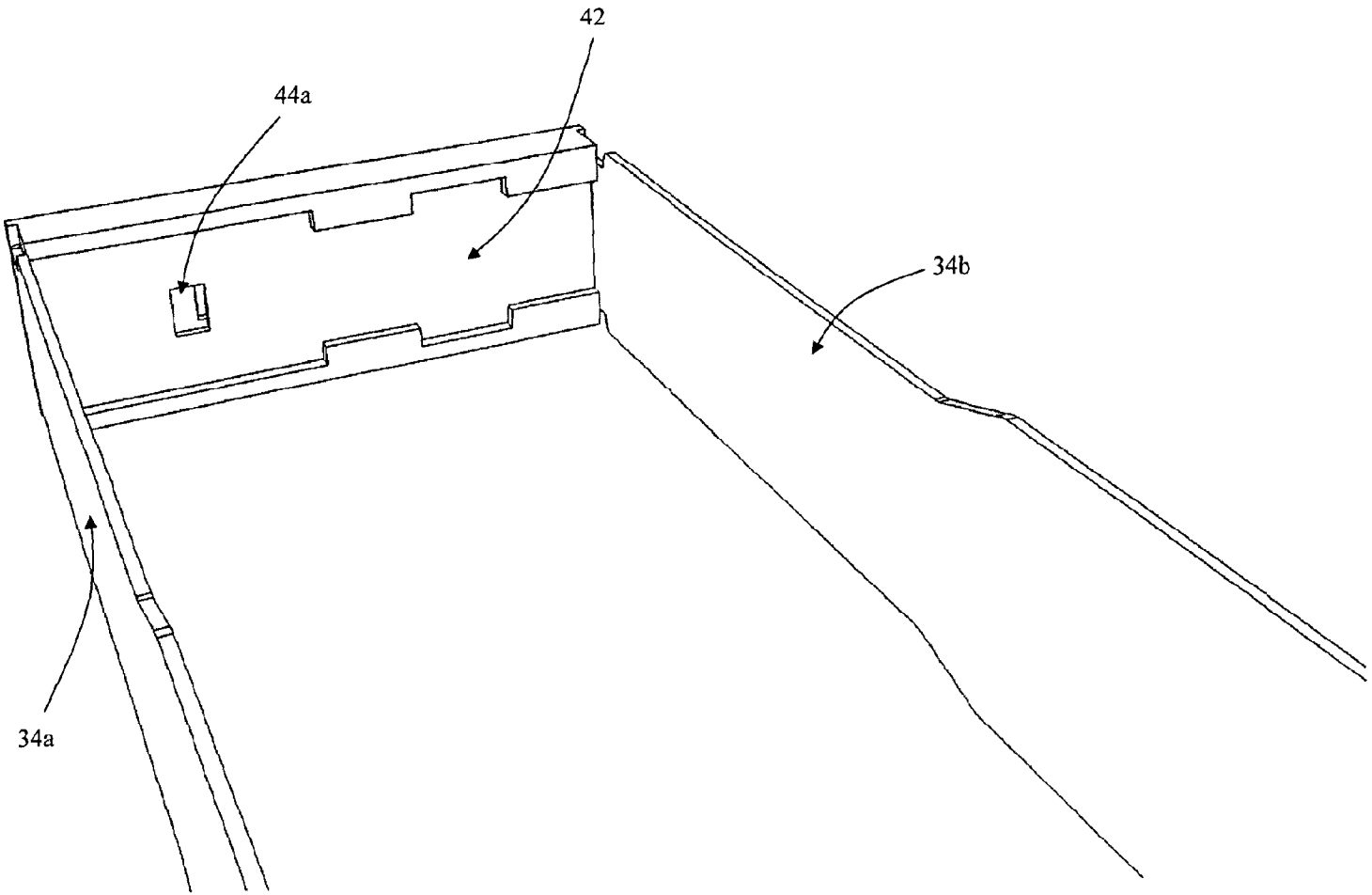

Referring to FIGS. 5*a*-5*d* there is an exemplary embodiment of a container according to one aspect of the present invention which is width adjustable. This has the significant benefit that different diameter bottles can be fitted within an adjustable container utilising minimum shelf space and also ensuring the bottles are aligned. The container comprises side walls 34 and end walls including a receiving element 32. The first side wall 34*a* is integrally formed with a portion 38 that extends substantially perpendicular to the side wall 34*a*. This portion 38 is fixedly secured to the receiving element 32 via a retaining catch 40. The opposing second side wall 34*b* also has a respective portion 42 which is integrally and fixedly formed with the second side portion 34*b*. However, this second side portion 42 moves relative to the receiving element 32. FIG. 5*a* shows the second side portion 42 in its maximum extended configuration providing the maximum width of the container. In this configuration release of the second side portion 42 from the retaining element is prevented via a retaining catch 44 which seats within a corresponding aperture 44*a* in order to prevent accidental release. FIGS. 5*b*-5*d* show the width of the container decreasing as the second side portion is further received by the receiving element 32.

Accordingly, it will be appreciated that the relative width of the container can be changed to accommodate different diameter bottles as required. A friction engagement between the second side portion 42 and the retaining element 32 is achieved, and the second side portion 42 runs along a channel provided in the retaining element 32, in a direction parallel to the longitudinal length of the first side portion 38.

Referring to FIG. 6 there is a schematic perspective view of a container according to an exemplary embodiment of an aspect of the present invention which is adjustable in width. The container 28 is symmetrical meaning that a receiving element 32 is provided at each end. Each of the side walls has at one end a first side portion 38 and at the opposing end a second side portion 42. This means that the container can be used with either end at the front or rear of the shelf, and can be turned upside down without compromising use of the container.

The side walls 34*a* and 34*b* have a profile where the depth or height decreases towards their ends or intersection with the first side portion 38 or second side portion 42. The depth or height of the side walls is reduced, meaning that when the container sits on the shelf surface a portion of the side walls 34*a*, 34*b* does not contact the shelf surface. This is important as it means that when the receiving element 32 is lifted and withdrawn to face the bottles, it is the receiving element 32 not the side walls 34*a*, 34*b* that contacts the surface of the shelf.

The present invention has been described by way of example only and it will be appreciated by a skilled addressee that modifications and variations may be made without departing from the scope of protection afforded by the appended claims.

The invention claimed is:

1. A kit for aligning products on a shelf and manually drawing one or more products across the shelf, the kit comprising:

a container having an open bottom for aligning and for manually drawing products across the shelf, the container defining a zone for aligning products on the shelf, the zone defined between an opposing pair of side walls and opposing pair of end walls of the container;

a riser comprising an arrangement for securing the riser adjacent an edge of the shelf; and a spacer element having a rearward edge defining a product surface for maintaining a product spaced apart from the riser, wherein a zone is defined between the riser and the rearward edge to accommodate one of the end walls of the container when the container is not in use;

wherein the end wall of the container accommodated by the zone is movable upwardly and arranged to be lifted from the zone and drawn away from the shelf in operation, and subsequently pushed towards the shelf and the end wall lowered to be accommodated in the zone when not in use.

2. The kit according to claim 1, wherein the spacer element is fixedly attached to the riser.

3. The kit according to claim 2, wherein the riser has a longitudinal length and the spacer element includes a protruding member extending generally perpendicular to the longitudinal length of the riser.

4. The kit according to claim 3, wherein the protruding member provides a surface for accommodating an end wall of the container.

5. The kit according to claim 4, wherein the protruding member projects across the shelf when in use.

6. The kit according to claim 4, wherein the protruding member defines a channel for receiving an end wall of the container.

7. The kit according to claim 6, wherein the channel is provided between a lip and the longitudinal length of the riser.

8. The kit according to claim 7, wherein the lip extends substantially parallel to the longitudinal length of the riser.

9. The kit according to claim 8, wherein the lip is substantially continuous.

10. The kit according to claim 1, wherein the arrangement for securing the riser to the shelf comprises one or more deformable ribs.

11. The kit according to claim 1, wherein the container comprises first and second opposing side walls, where at least one of the first or second end walls includes an end wall portion secured to a side wall, the end wall portion being received by a retaining element secured to the opposing side wall, wherein the end wall portion is moveable relative to the retaining element to enable adjustment of the span between the opposing side walls of the container.

12. The kit according to claim 11, wherein the container comprises a receiving element at both opposing end walls.

13. The kit according to claim 11, wherein the receiving element includes a channel for receiving the end wall portion and enabling moveable engagement therebetween.

14. The kit according to claim 11, wherein at least one side wall is fixed relative to the receiving element.

15. The kit according to claim 11, wherein the side walls are substantially parallel and comprise end wall portions extending perpendicular to the side walls, each of the end wall portions being received by the receiving element.

16. The kit according to claim 15, wherein one side wall portion is fixed relative to the receiving element.

17. The kit according to claim 11, wherein the receiving element includes a retaining member arranged to prevent release of the moveable end portion from the receiving element.

18. The kit according to claim 11, wherein each of the side wall comprises a notch adjacent the intersection between the respective side wall and end wall.

19. The kit according to claim 11, wherein the side wall has a variable height.

20. The kit according to claim 11, wherein at least one side wall tapers towards the intersection between the side wall and the end wall.

21. The kit according to claim 11, wherein each end of the container includes a receiving element.

22. A kit for aligning products on a shelf and manually drawing one or more products across the shelf, the kit comprising:

a container having an opposing pair of upwardly extending side walls and opposing pair of upwardly extending end walls, and an open bottom for containing products within the side and end walls, and aligning and for manually drawing products in contact with the shelf, across the shelf, the container defining a zone for aligning products on the shelf, the zone defined between the opposing pair of side walls and opposing pair of end walls of the container;

a riser comprising an arrangement for securing the riser adjacent an edge of the shelf; and a spacer element having a rearward edge defining a product surface for maintaining a product spaced apart from the riser, wherein a zone is defined between the riser and the rearward edge to accommodate one of the end walls of the container when the container is not in use wherein the end wall of the container accommodated by the zone is movable upwardly and arranged to be lifted from the zone and drawn away from the shelf in operation, and subsequently pushed towards the shelf and the end wall lowered to be accommodated in the zone when not in use.

* * * * *